US005348641A

United States Patent [19]

Shih

[11] Patent Number: 5,348,641

[45] Date of Patent: Sep. 20, 1994

[54] GASOLINE UPGRADING PROCESS

[75] Inventor: Stuart S. Shih, Cherry Hill, N.J.

[73] Assignee: Mobil Oil Corporation, Fairfax, Va.

[21] Appl. No.: 880,373

[22] Filed: May 8, 1992

Related U.S. Application Data

[63] Continuation-in-part of Ser. No. 850,106, Mar. 12, 1992, and a continuation-in-part of Ser. No. 745,311, Aug. 15, 1991.

[51] Int. Cl.[5] ..... C10G 69/02

[52] U.S. Cl. ..... 208/89; 208/212; 208/213

[58] Field of Search ..... 208/58, 89

[56] References Cited

U.S. PATENT DOCUMENTS

| | | | |
|---|---|---|---|
| 3,458,433 | 7/1969 | Jaffe | 208/89 |
| 3,549,515 | 12/1970 | Wood et al. | 208/89 |
| 3,663,424 | 5/1972 | Brainard et al. | 208/89 |
| 3,728,251 | 4/1973 | Kelley et al. | 208/89 |
| 3,729,409 | 4/1973 | Chen | 208/135 |
| 3,759,821 | 9/1973 | Brennan et al. | 208/93 |
| 3,767,568 | 10/1973 | Chen | 208/134 |
| 3,957,625 | 5/1976 | Orkin | 208/211 |
| 4,049,542 | 9/1977 | Gibson et al. | 208/213 |
| 4,057,488 | 11/1977 | Montagner et al. | 208/89 |
| 4,062,762 | 12/1977 | Howard et al. | 208/211 |
| 4,210,521 | 7/1980 | Gorring et al. | 208/89 |
| 4,414,097 | 11/1983 | Chester et al. | 208/59 |
| 4,738,766 | 4/1988 | Fischer et al. | 208/68 |
| 4,753,720 | 6/1988 | Morrison | 208/135 |
| 4,827,076 | 5/1989 | Kokayeff et al. | 208/213 |
| 5,000,839 | 3/1991 | Kirker et al. | 208/89 |
| 5,143,596 | 9/1992 | Maxwell et al. | 208/89 |

*Primary Examiner*—Helane Myers

*Attorney, Agent, or Firm*—A. J. McKillop; M. D. Keen

[57] ABSTRACT

Low sulfur gasoline of relatively high octane number is produced from a catalytically cracked, sulfur-containing naphtha by hydrodesulfurization followed by treatment over an acidic catalyst, preferably an intermediate pore size zeolite such as ZSM-5. The treatment over the acidic catalyst in the second step, which is carried out in a hydrogen atmosphere which is essentially free of hydrogen sulfide and ammonia, restores the octane loss which takes place as a result of the hydrogenative treatment and results in a low sulfur gasoline product with an octane number comparable to that of the feed naphtha. The hydrogen supplied to the second step may be make-up hydrogen with recycle hydrogen routed to the hydrodesulfurization step after removal of ammonia and hydrogen sulfide in a scrubber.

6 Claims, 1 Drawing Sheet

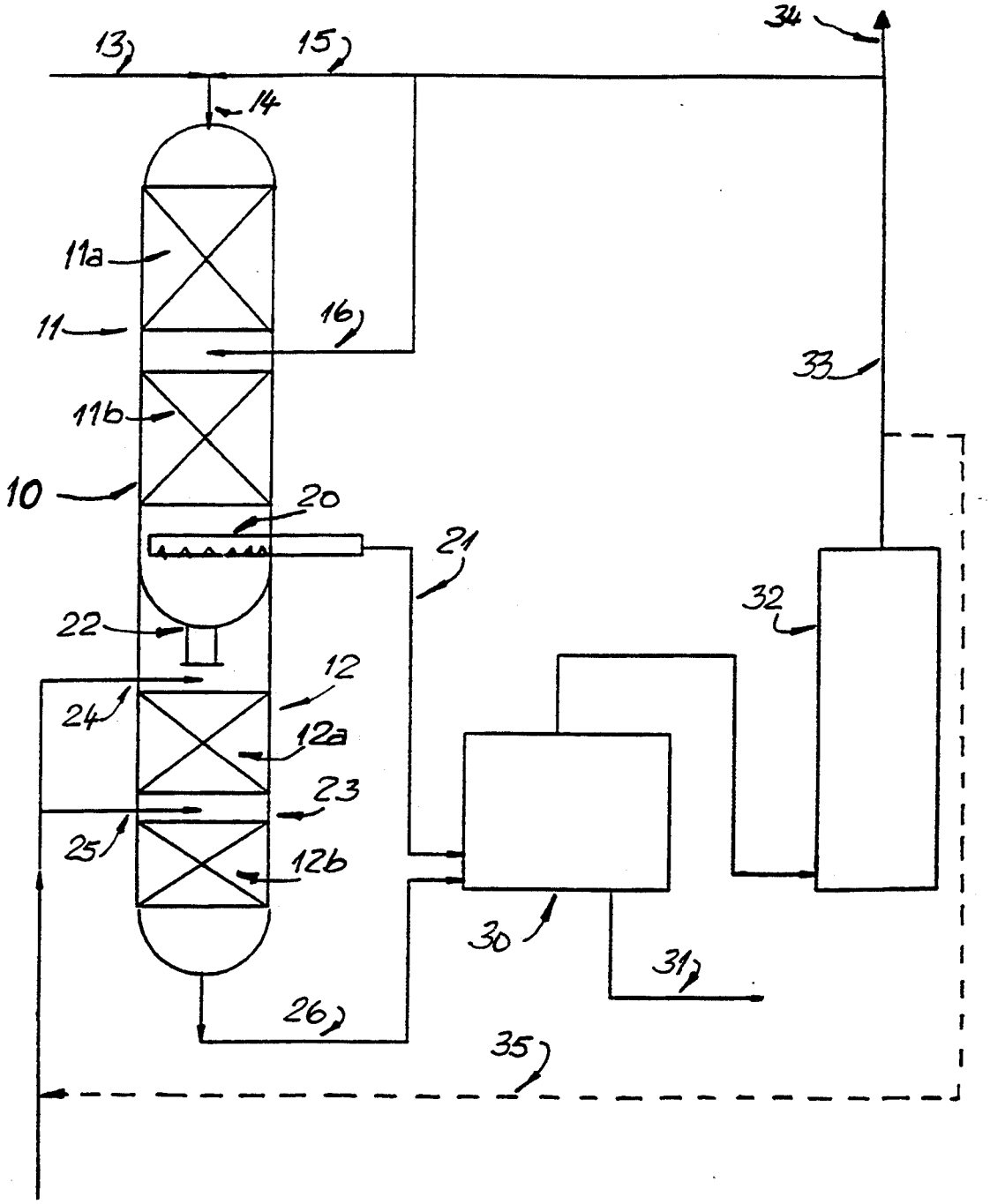
13
15
34
14
11a
11
16
33
11b
10
20
21
32
22
12
24
12a
23
25
12b
30
31
26
35

GASOLINE UPGRADING PROCESS

This application is a continuation-in-part of our prior applications Ser. Nos. 07/850,106, filed Mar. 12, 1992 pending, and a continuation in part of 07/745,311, filed Aug. 15, 1991 pending.

FIELD OF THE INVENTION

This invention relates to a process for the upgrading of hydrocarbon streams. It more particularly refers to a process for upgrading gasoline boiling range petroleum fractions containing substantial proportions of sulfur impurities.

BACKGROUND OF THE INVENTION

Catalytically cracked gasoline currently forms a major part of the gasoline product pool in the United States and it provides a large proportion of the sulfur in the gasoline. The sulfur impurities may require removal, usually by hydrotreating, in order to comply with product specifications or to ensure compliance with environmental regulations, both of which are expected to become more stringent in the future, possibly permitting no more than about 300 ppmw sulfur in motor gasolines; low sulfur levels result in reduced emissions of CO, $NO_x$ and hydrocarbons.

Naphthas and other light fractions such as heavy cracked gasoline may be hydrotreated by passing the feed over a hydrotreating catalyst at elevated temperature and somewhat elevated pressure in a hydrogen atmosphere. One suitable family of catalysts which has been widely used for this service is a combination of a Group VIII and a Group VI element, such as cobalt and molybdenum, on a substrate such as alumina. After the hydrotreating operation is complete, the product may be fractionated, or simply flashed, to release the hydrogen sulfide and collect the now sweetened gasoline.

Cracked naphtha, as it comes from the catalytic cracker and without any further treatments, such as purifying operations, has a relatively high octane number as a result of the presence of olefinic components. In some cases, this fraction may contribute as much as up to half the gasoline in the refinery pool, together with a significant contribution to product octane.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Hydrocracking reactions may also take place in addition to olefin saturation, depending on the conditions of the hydrotreating operation.

Various proposals have been made for removing sulfur while retaining the more desirable olefins. The sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

U.S. Pat. No. 4,049,542 (Gibson) discloses a process in which a copper catalyst is used to desulfurize an olefinic hydrocarbon feed such as catalytically cracked light naphtha. This catalyst is stated to promote desulfurization while retaining the olefins and their contribution to product octane.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels. This inherent tension is yet more marked in the current supply situation for low sulfur, sweet crudes.

Processes for improving the octane rating of catalytically cracked gasolines have been proposed. U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

The octane rating of the gasoline pool may be increased by other methods, of which reforming is one of the most common. Light and full range naphthas can contribute substantial volume to the gasoline pool, but they do not generally contribute significantly to higher octane values without reforming. They may, however, be subjected to catalytically reforming so as to increase their octane numbers by converting at least a portion of the paraffins and cycloparaffins in them to aromatics. Fractions to be fed to catalytic reforming, for example, with a platinum type catalyst, need to be desulfurized before reforming because reforming catalysts are generally not sulfur tolerant; they are usually pretreated by hydrotreating to reduce their sulfur content before reforming. The octane rating of reformate may be increased further by processes such as those described in U.S. Pat. No. 3,767,568 and U.S. Pat. No. 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components.

In our co-pending Applications Ser. Nos. 07/850,106, filed Mar. 12, 1992, and Ser. No. 07/745,311, filed Aug. 15, 1991, we have described processes for the upgrading of gasoline by sequential hydrotreating and selective cracking steps. In the first step of the process, the naphtha is desulfurized by hydrotreating and during this step some loss of octane results from the saturation of olefins. The octane loss is restored in the second step by a shape-selective cracking, preferably carried out in the presence of an intermediate pore size zeolite such as ZSM-5. The product is a low-sulfur gasoline of good octane rating. Reference is made to Ser. Nos. 07/745,311 and 07/850,106 for a detailed description of these processes.

The process described in Applications Ser. Nos. 07/745,311 and 07/850,106, can desulfurize FCC gasoline to low sulfur without significant octane loss. Under conventional down-flow fixed-bed conditions operating in direct cascade, however, ammonia and hydrogen sulfide generated by the hydrodesulfurization catalyst at top of the reactor can poison the zeolite catalyst at bottom of the reactor so that the octane recovery which takes place over the zeolite catalyst may be jeopardized. It would, of course, be possible to operate the process with two reactors and an interstage $H_2S$/ $NH_3$ removal unit to provide a $H_2S/NH_3$-free hydrogen stream for the second reactor filled with the zeolite catalyst. This two-stage approach, however, requires two reactors and an additional feed pre-heater for the second reactor.

SUMMARY OF THE INVENTION

We have now devised a novel configuration for the gasoline upgrading process which may be used to eliminate or reduce the poisoning effect of the ammonia and hydrogen sulfide released in the hydrodesulfurization step. This configuration may be used in a single reactor or, if desired, may be adapted to a two-reactor configuration but without the necessity of interstage heteroatom removal or of interstage heating.

According to the present invention, the hydrogen stream which is introduced to the top of the zeolite catalyst bed is essentially free of inorganic nitrogen and sulfur i.e. ammonia and hydrogen sulfide. This gas stream may be the make-up hydrogen either by itself or combined with some recycle from the scrubber. The effluent gas from the zeolite catalyst bed is directed to the top of the hydrodesulfurization (HDS) catalyst bed. The effluent gas from the HDS catalyst bed that contains $H_2S$ and $NH_3$ is purified to remove the inorganic hetroatom contaminants and is then recycled back to the hydrodesulfurization bed. By contacting the zeolite catalyst with a $H_2S/NH_3$-free hydrogen stream, the improved process also eliminates the potential for combination reactions of $H_2S$ and olefins to form hydrocarbon sulfides. Consequently, it produces very low sulfur hydrofinished FCC gasoline without significant octane loss.

In this configuration, the FCC gasoline or other feed preferably flows downward through the HDS and zeolite catalyst beds or, alternatively, a $H_2S/NH_3$-free stream can be made to flow against the downstream feedstock flow (counter-flow reactor), thus avoiding contamination of the zeolite bed at the bottom of the reactor. However, the counter-flow reactor is more expensive to operate than the concurrent, down-flow reactor because of the high pressure drop.

According to the present invention, therefore, a sulfur-containing cracked petroleum fraction in the gasoline boiling range is hydrotreated, in a first step, under conditions which remove at least a substantial proportion of the sulfur. Hydrotreated intermediate product is then treated, in a second step, by contact with a catalyst of acidic functionality under conditions which convert the hydrotreated intermediate product fraction to a fraction in the gasoline boiling range of higher octane value. Hydrogen gas which is essentially free of inorganic sulfur and nitrogen is supplied to the second step; the first step (hydrodesulfurization) is carried out in the presence of recycle hydrogen.

BRIEF DESCRIPTION OF THE DRAWINGS

The single FIGURE is a simplified schematic of the reactor configuration for carrying out the process.

DETAILED DESCRIPTION

Feed

As described in Ser. Nos. 07/745,311 and 07/850,106, the feed to the process comprises a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° to 412° F., or heavy gasoline fractions boiling at, or at least within, the range of about 330°to 500° F., preferably about 330° to 412° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F. (163° C.) and preferably at least about 350° F. (177° C.), for example, 95 percent points of at least 380° F. (about 193° C.) or at least about 400° F. (about 220° C.).

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F.(93° C.) to about 300° F. (150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F. (65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F. (82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 14,000 or 15,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F.(193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent.

Process Configuration

The process is carried out in the same overall manner as described in Ser. Nos. 07/745,311 and 07/850,106, to which reference is made for details of the process. First, the selected sulfur-containing, gasoline boiling range feed is hydrotreated the feed by effective contact of the feed with a hydrotreating catalyst, which is suitably a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content and a lower octane number than the feed.

This hydrotreated intermediate product which also boils in the gasoline boiling range (and usually has a boiling range which is not substantially higher than the boiling range of the feed), is then treated by contact with an acidic catalyst under conditions which produce a second product comprising a fraction which boils in the gasoline boiling range which has a higher octane number than the portion of the hydrotreated intermediate product fed to this second step. The product form this second step usually has a boiling range which is not substantially higher than the boiling range of the feed to the hydrotreater, but it is of lower sulfur content while having a comparable octane rating as the result of the second stage treatment.

The catalyst used in the second stage of the process has a significant degree of acid activity, and for this purpose the most preferred materials are the crystalline refractory solids having an intermediate effective pore size and the topology of a zeolitic behaving material, which, in the aluminosilicate form, has a constraint index of about 2 to 12.

The FIGURE shows a simplified reactor and process flow diagram that will eliminate the $H_2S/NH_3$ poisoning of the zeolite catalyst used in the gasoline upgrading process. The unit comprises a reactor 10 with two reaction zones 11, 12 to accommodate the two catalysts required by the process. In the FIGURE, there are four catalyst beds in the reactor with the HDS catalyst in beds 11*a* and 11*b* and the acidic catalyst e.g. the zeolite, in beds 12*a* and 12*b*. The gasoline boiling range feed is introduced through line 13 and inlet 14 with recycle hydrogen coming through line 15. A hydrogen quench injection point 16 is provided at the interbed position for the reactor temperature control; in a multi-bed reactor additional quench points may be provided between the successive beds, as is conventional. A perforated gas collector 20 connected to gas outlet line 21 is inserted beneath the bed of HDS catalyst to remove the hydrogen which is now contaminated with the sulfur and nitrogen removed from the feed in the form of ammonia and hydrogen sulfide. The liquid effluent from the HDS step passes out of the top portion of the reactor through funnel 22 and enters the lower portion 23 of reactor 10, which contains the zeolite catalyst which restores the octane lost in the HDS reaction.

The liquid effluent is then passed through the lower catalyst bed after passing through a distributor tray (not shown, of conventional type). Make-up hydrogen is injected into the lower portion 23 of the reactor at two points, 24, 25. Since the reactions which take place in this catalyst bed are mainly endothermic, there is no great need for sequential injection but improved gas/-liquid contact and mixing may be provided by providing a distributor tray with the hydrogen injection at the inter-bed location as shown. Channeling is also reduced by the use of re-distribution.

The mixed phase effluent from the lower portion of the reactor passes through line 26 to a vapor/liquid separator 30 which also receives the gas removed from the HDS bed through line 21. The hydrogen is separated from the liquid in separator 30 and the liquid gasoline product is recovered through product line 31 (in practice, the separation will take place in sequential separators with the hydrogen and light gases being first separated from the $C_5+$ gasoline fraction with subsequent separation of the recycle hydrogen from the light ends produced in the HDS step). The hydrogen passes to a conventional amine adsorbing unit 32 which removes the ammonia and hydrogen sulfide. The purified gas stream (recycled hydrogen) from the amine unit is used to provide hydrogen for the HDS reaction by recycle through line 33. Some hydrogen may be vented through vent line 34 to maintain adequate hydrogen purity. Some purified hydrogen may be recycled through line 35 and mixed with the make-up hydrogen to provide a low $H_2S/NH_3$ content hydrogen stream for the zeolite catalyst.

The hydrogen supplied to the second catalyst section has a hydrogen sulfide partial pressure of less than about 5 psia (about 35 kPaa) and an ammonia partial pressure of less than about 0.1 psia (700 Paa). Provided these limitations are observed, recycle hydrogen may be added to the make-up stream. By maintaining the partial pressures of the hydrogen sulfide and ammonia at a low level in the second step of the process, catalyst poisoning is eliminated or reduced to acceptable levels) so that the second catalyst is able to carry out the desired reactions which restore the octane lost in the HDS step.

Hydrotreating

The temperature of the hydrotreating step is suitably from about 400° to 850° F. (about 220° to 454° C.), preferably about 500° to 800 ° F. (about 260° to 427° C.)

with the exact selection dependent on the desulfurization desired for a given feed and catalyst. Because the hydrogenation reactions which take place in this stage are exothermic, a rise in temperature takes place along the reactor; this is actually favorable to the overall process when it is operated in the cascade mode because the second step is one which implicates cracking, an endothermic reaction. In this case, therefore, the conditions in the first step should be adjusted not only to obtain the desired degree of desulfurization but also to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the second step of the reaction. When operated in the two-stage configuration with interstage separation and heating, control of the first stage exotherm is obviously not as critical; two-stage operation may be preferred since it offers the capability of decoupling and optimizing the temperature requirements of the individual stages.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{-1}$.). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni-Mo or Co-Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, such as: a down-flow, liquid phase, fixed bed process; an up-flow, fixed bed, trickle phase process; an ebulating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

A change in the volume of gasoline boiling range material typically takes place in the first step. Although some decrease in volume occurs as the result of the conversion to lower boiling products ($C_5-$), the conversion to $C_5-$ products is typically not more than 5 vol percent and usually below 3 vol percent and is normally compensated for by the increase which takes place as a result of aromatics saturation. An increase in volume is typical for the second step of the process where, as the result of cracking the back end of the hydrotreated feed, cracking products within the gasoline boiling range are produced. An overall increase in volume of the gasoline boiling range ($C_5+$) materials may occur.

Octane Restoration—Second Step Processing

After the hydrotreating step, the hydrotreated intermediate product is passed to the second step of the process in which a controlled degree of shape-selective cracking of the desulfurized, hydrotreated effluent from the first step takes place in the presence of the catalyst and the pure hydrogen stream to produce olefins which restore the octane rating of the original, cracked feed at least to a partial degree. The reactions which take place during the second step are mainly the shape-selective cracking of low octane paraffins to form higher octane products, both by the selective cracking of heavy paraffins to lighter paraffins and the cracking of low octane n-paraffins, in both cases with the generation of olefins. Some isomerization of n-paraffins to branched-chain paraffins of higher octane may take place, making a further contribution to the octane of the final product. In favorable cases, the original octane rating of the feed may be completely restored or perhaps even exceeded. Since the volume of the second stage product will typically be comparable to that of the original feed or even exceed it, the number of octane barrels (octane rating x volume) of the final, desulfurized product may exceed the octane barrels of the feed.

The conditions used in the second step are those which are appropriate to produce this controlled degree of cracking. Typically, the temperature of the second step will be about 300° to 900 ° F. (about 150° to 480° C.), preferably about 350° to 800 ° F. (about 177° C.). As mentioned above, however, a convenient mode of operation is to cascade the hydrotreated effluent into the second reaction zone and this will imply that the outlet temperature from the first step will set the initial temperature for the second zone. The feed characteristics and the inlet temperature of the hydrotreating zone, coupled with the conditions used in the first stage will set the first stage exotherm and, therefore, the initial temperature of the second zone. Thus, the process can be operated in a completely integrated manner, as shown below.

The pressure in the second reaction zone is not critical since no hydrogenation is desired at this point in the sequence although a lower pressure in this stage will tend to favor olefin production with a consequent favorable effect on product octane. The pressure will therefore depend mostly on operating convenience and will typically be comparable to that used in the first stage, particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 n.l.$1^{-1}$.) preferably about 100 to 2500 SCF/Bbl (about 18 to 445 n.l.$1^{-1}$.) will be selected to minimize catalyst aging.

The use of relatively lower hydrogen pressures thermodynamically favors the increase in volume which occurs in the second step and for this reason, overall lower pressures are preferred if this can be accommodated by the constraints on the aging of the two catalysts.

Consistent with the objective of restoring lost octane while retaining overall product volume, the conversion to products boiling below the gasoline boiling range ($C_5$−) during the second stage is held to a minimum. However, because the cracking of the heavier portions of the feed may lead to the production of products still within the gasoline range, no not conversion to $C_5$− products may take place and, in fact, a net increase in $C_5$+ material may occur during this stage of the process, particularly if the feed includes significant amount of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

The catalyst used in the second step of the process possesses sufficient acidic functionality to bring about the desired cracking reactions to restore the octane lost in the hydrotreating step. The preferred catalysts for this purpose are described in Applications Ser. Nos. 07/745,311 and 07/ , mentioned above. Intermediate pore size zeolites which have a Constraint Index between about 2 and 12 are preferred for octane restoration, for example, ZSM-5, ZSM-11, ZSM-12, ZSM-22, ZSM-23, ZSM-35, ZSM-48, ZSM-50 or MCM-22. Zeolite MCM-22 is described in U.S. Pat. Nos. 4,954,325 and 4,962,256. Other catalytic materials having the appropriate acidic functionality may, however, be employed. A particular class of catalytic materials which may be used are, for example, the large pores size zeolite materials which have a Constraint Index of up to about 2 (in the aluminosilicate form). Zeolites of this type include mordenite, zeolite beta, faujasites such as zeolite Y and ZSM-4.

The catalyst should have sufficient acid activity to have cracking activity with respect to the second stage feed (the intermediate fraction), that is sufficient to convert the appropriate portion of this material as feed. One measure of the acid activity of a catalyst is its alpha number (see Applications Ser. Nos. 07/745,311 and 07/850,106). The catalyst suitably has an alpha activity of at least about 20, usually in the range of 20 to 800 and preferably at least about 50 to 200. It is inappropriate for this catalyst to have too high an acid activity because it is desirable to only crack and rearrange so much of the intermediate product as is necessary to restore lost octane without severely reducing the volume of the gasoline boiling range product.

The active component of the catalyst e.g. the zeolite will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina.

Hydrogen sulfide not only reduces the activity of the acidic zeolite catalysts, it also promotes combination reactions between the $H_2S$ generated in the hydrodesulfurization step and the olefins resulting from the reactions in the second step of the process, illustrated simply as:

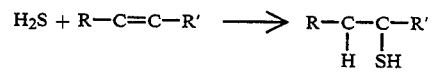

The combination reactions are enhanced if the zeolite catalyst contains a metal, such as nickel. The combination reactions limit the ability of the process to produce a very low-sulfur gasoline but by separating the hydrogen sulfide before contact with the zeolite catalyst, the potential for recombination can be significantly reduced or eliminated.

The improved process also provides flexibility for the zeolite catalyst selection and allows the process to produce very low-sulfur gasoline without octane loss.

EXAMPLES

The following examples illustrate the operation of the present process. In these examples, parts and percentages are by weight unless they are expressly stated to be on some other basis. Temperatures are in ° F and pressures in psig, unless expressly stated to be on some other basis.

To determine the effect of $H_2S$ on ZSM-5, a 650°–905° F. gas oil was mixed with 1-hexanethiol to provide various $H_2S$ partial pressures at reaction conditions (525° F., 1500 psig, and 0.5 LHSV). In one example, $H_2S$ was directly added into the hydrogen stream (e.g., using a 2% $H_2S$/98% $H_2$ gas). An unsteamed Ni-ZSM-5/$Al_2O_3$ catalyst was used in the experiments. The pour point of the products is correlated with the activity of the ZSM-5 catalyst. As shown in Table 1, at high $H_2S$ partial pressures (>1.6 psia $H_2S$), the activity of ZSM-5 was significantly inhibited.

Experiments were repeated with an unsteamed H-ZSM-5/$Al_2O_3$ catalyst. The effects of $H_2S$ are similar, as shown in Table 1 below.

TABLE 1

| Effect of H2S on ZSM-5 Activity | | | | | |
|---|---|---|---|---|---|
| Added S Compound | None | 1-Hexanethiol | | | H2S |
| Unsteamed Ni-ZSM-5/A1203 | | | | | |
| $P_{H2S}$, psia | <0.1 | 1.6 | 5.5 | 15.4 | 27.6 |
| 330° F.+ Product Pour Point, °F. | >120 | 0 | 15 | 65 | 70 |
| Unsteamed H-ZSM-5/A1203 | | | | | |
| $P_{H2S}$, psia | <0.1 | | 15.4 | | 27.6 |
| 330° F.+ Product Pour Point, °F. | −5 | | 90 | | 85 |

The $H_2S$ poisoning can be mitigated by operating the ZSM-5 catalyst at higher temperatures. For example, the activity loss of the unsteamed Ni-ZSM-5/$Al_2O_3$ catalyst at 27.6 psia $H_2S$ (using a 2%$H_2S$/98%$H_2$ gas) was recovered by raising the reactor temperature from 525° F. to 575° F., with the remaining conditions remaining constant, as shown in Table 2.

TABLE 2

H2S and Temperature Effects on ZSM-5 Activity

| | Unsteamed Ni-ZSM-5/A1203 | | | |
|---|---|---|---|---|
| $P_{H2S}$, psia | <0.1 | | 27.6 | |
| Temperature, °F. | 525 | 525 | 551 | 576 |
| 330° F.+ Product Pour Point, °F. | −5 | 75 | 35 | −15 |

We claim:

1. A process of upgrading a sulfur-containing feed fraction boiling in the gasoline boiling range in an upgrading process in which hydrogen is supplied to a hydrodesulfurization zone and a second reaction zone in a hydrogen circuit including a scrubber for removing hydrogen sulfide and ammonia from hydrogen from the reaction zones to provide recycle hydrogen for the hydrodesulfurization zone, and to supply make-up hydrogen to the hydrogen circuit, which process comprises:

hydrodesulfurizing a catalytically cracked, olefinic, sulfur-containing gasoline feed having a sulfur content of at least 50 ppmw, an olefin content of at least 5 percent and a 95 percent point of at least 325° F. with a hydrodesulfurization catalyst in the hydrodesulfurization zone to which the recycle hydrogen is fed, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone to which the make-up hydrogen is fed, with an acidic zeolite catalyst in an atmosphere of hydrogen at a hydrogen sulfide partial pressure of not more than 5 psia and an ammonia partial pressure of not more than 0.1 psia, to convert the gasoline boiling range portion of the intermediate product to a product comprising a fraction boiling in the gasoline boiling range having a higher octane number than the gasoline boiling range fraction of the intermediate product.

2. The process of claim 1 in which the recycle hydrogen is injected into the hydrodesufurization zone at axially spaced locations along the length of the zone.

3. The process as claimed in claim 1 in which hydrogen is removed from the intermediate product before the intermediate product enters the second reaction zone.

4. The process as claimed in claim 1 in which the feed fraction has a 95 percent point of at least 350° F., an olefin content of 10 to 20 weight percent, a sulfur content from 100 to 15,000 ppmw and a nitrogen content of 5 to 250 ppmw.

5. The process as claimed in claim 4 in which said feed fraction comprises a naphtha fraction having a 95 percent point of at least about 380° F.

6. The process as claimed in claim 1 in which the acidic catalyst of the second reaction zone comprises an intermediate pore size zeolite having the topology of ZSM-5 and is in the aluminosilicate form.

* * * * *